US006933058B2

(12) United States Patent
Darolia

(10) Patent No.: US 6,933,058 B2
(45) Date of Patent: Aug. 23, 2005

(54) BETA-PHASE NICKEL ALUMINIDE COATING

(75) Inventor: Ramgopal Darolia, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/707,252

(22) Filed: Dec. 1, 2003

(65) Prior Publication Data

US 2005/0118453 A1 Jun. 2, 2005

(51) Int. Cl.[7] ..... B32B 15/04; B32B 5/14
(52) U.S. Cl. ..... 428/610; 428/632; 428/680
(58) Field of Search ..... 428/610, 650, 428/680, 632, 469, 621, 679; 416/241 R

(56) References Cited

U.S. PATENT DOCUMENTS 5,507,623 A * 4/1996 Kojima et al. ..... 416/241 R
5,975,852 A 11/1999 Nagaraj et al. ..... 416/241
6,139,976 A * 10/2000 Czech et al. ..... 428/610
6,153,313 A 11/2000 Rigney et al. ..... 428/632
6,255,001 B1 7/2001 Darolia ..... 428/610
6,291,084 B1 * 9/2001 Darolia et al. ..... 428/633
6,620,518 B2 * 9/2003 Lavery et al. ..... 428/450
6,620,524 B2 9/2003 Pfaendtner et al. ..... 428/632
6,669,989 B2 * 12/2003 Movchan et al. ..... 427/249.5

* cited by examiner

*Primary Examiner*—Jennifer McNeil
(74) *Attorney, Agent, or Firm*—David L. Narciso; Gary M. Hartman; Domenica N. S. Hartman

(57) ABSTRACT

A protective overlay coating for articles used in hostile thermal environments, and more particularly a predominantly beta-phase NiAl intermetallic overlay coating for use as an environmental coating or as a bond coat for a thermal barrier coating deposited on the overlay coating. The overlay coating has inner and outer regions, with the inner region containing more chromium than the outer region. The lower chromium content of the outer region promotes the oxidation resistance of the overlay coating, while the higher chromium content of the inner region promotes the hot corrosion resistance of the coating interior. Under hot corrosion conditions, hot corrosion may attack the outer region, but further hot corrosion attack will substantially cease once the relatively high-chromium inner region of the overlay coating is encountered.

20 Claims, 1 Drawing Sheet

BETA-PHASE NICKEL ALUMINIDE COATING

BACKGROUND OF INVENTION

1. Field of the Invention

The present invention generally relates to coatings of the type used to protect components subjected to oxidation and hot corrosion in high temperature environments, such as the hostile environment of a gas turbine engine. More particularly, this invention is directed to an overlay coating of predominantly beta-phase NiAl (βNiAl), in which the chemistry of the coating varies to promote oxidation resistance at its outer region and hot corrosion resistance within an inner region of the coating.

2. Description of the Related Art

Components within the turbine, combustor and augmentor sections of gas turbine engines are susceptible to oxidation and hot corrosion attack, in addition to high temperatures that can decrease their mechanical properties. Consequently, these components are often protected by an environmental coating alone or in combination with an outer thermal barrier coating (TBC), which in the latter case is termed a TBC system. Ceramic materials such as zirconia ($ZrO_2$) partially or fully stabilized by yttria ($Y_2O_3$), magnesia (MgO) or other oxides, are widely used as TBC materials.

Various metallic coating systems have been used as environmental coatings for gas turbine engine components, the most widely used being diffusion coatings such as diffusion aluminides and platinum aluminides (PtAl). Diffusion aluminide coatings are formed by reacting the surface of a component with an aluminum-containing vapor to deposit aluminum and form various aluminide intermetallics that are the products of aluminum and elements of the substrate material. Diffusion aluminide coatings formed in a nickel-base superalloy substrate contain such environmentally-resistant intermetallic phases as beta NiAl and gamma prime (y') $Ni_3Al$. By incorporating platinum, the coating further includes PtAl intermetallic phases, usually PtAl and $PtAl_2$, and platinum in solution in the NiAl intermetallic phases.

Another widely used coating system is an overlay coating known as MCrAlX, where M is iron, cobalt and/or nickel, and X is an active element such as yttrium or another rare earth or reactive element. MCrAlX overlay coatings are typically deposited by physical vapor deposition (PVD), such as electron beam PVD (EBPVD) or sputtering, or by plasma spraying. MCrAlX overlay coatings differ from diffusion aluminide coatings as a result of the elements transferred to the substrate surface and the processes by which they are deposited, which can result in only limited diffusion into the substrate. If deposited on a nickel-base superalloy substrate, an MCrAlX coating will comprise a metallic solid solution that contains both gamma prime and beta nickel aluminide phases.

Used in combination with TBC, a diffusion aluminide or MCrAlX overlay coating serves as a bond coat to adhere the TBC to the underlying substrate. The aluminum content of these bond coat materials provides for the slow growth of a strong adherent continuous aluminum oxide layer (alumina scale) at elevated temperatures. This thermally grown oxide (TGO) protects the bond coat from oxidation and hot corrosion, and chemically bonds the TBC to the bond coat.

More recently, overlay coatings of predominantly beta-phase nickel aluminide intermetallic have been proposed as environmental and bond coat materials. The NiAl beta phase exists for nickel-aluminum compositions of about 30 to about 60 atomic percent aluminum, the balance of the nickel-aluminum composition being nickel. Notable examples of beta-phase NiAl coating materials include commonly-assigned U.S. Pat. No. 5,975,852 to Nagaraj et al., which discloses a NiAl overlay bond coat optionally containing one or more active elements, such as yttrium, cerium, zirconium or hafnium, and commonly-assigned U.S. Pat. No. 6,291,084 to Darolia et al., which discloses a NiAl overlay coating material containing chromium and zirconium. Commonly-assigned U.S. Pat. Nos. 6,153,313 and 6,255,001 to Rigney et al. and Darolia, respectively, also disclose beta-phase NiAl bond coat and environmental coating materials. The beta-phase NiAl alloy disclosed by Rigney et al. contains chromium, hafnium and/or titanium, and optionally tantalum, silicon, gallium, zirconium, calcium, iron and/or yttrium, while Darolia's beta-phase NiAl alloy contains zirconium.

The beta-phase NiAl alloys of Nagaraj, Darolia et al., Rigney et al., and Darolia have been shown to improve the adhesion of a ceramic TBC layer, thereby inhibiting spallation of the TBC and increasing the service life of the TBC system. The alloys also exhibit good oxidation and hot corrosion resistance. However, a tradeoff appears to exist between oxidation and hot corrosion resistance. Therefore, further improvements are still desirable.

SUMMARY OF INVENTION

The present invention generally provides a protective overlay coating for articles used in hostile thermal environments, such as turbine, combustor and augmentor components of a gas turbine engine. The invention is particularly directed to a predominantly beta-phase NiAl intermetallic overlay coating for use as an environmental coating or as a bond coat for a thermal barrier coating (TBC) deposited on the overlay coating. An example of a suitable overlay coating contains nickel, aluminum, chromium, and a reactive element such as zirconium.

According to the invention, the overlay coating comprises inner and outer regions, with the inner region containing more chromium than the outer region and also preferably less aluminum than the outer region. As a result of their different compositions, the outer region promotes the oxidation resistance of the overlay coating while the inner region promotes the hot corrosion resistance of the interior of the overlay coating. For those surface regions of the overlay coating subjected to relatively high temperatures requiring optimum oxidation resistance, the outer region of the overlay coating provides a desirable level of oxidation protection. In comparison, at cooler regions of the overlay coating where damage from hot corrosion is more likely, hot corrosion may attack the outer region (containing lower amounts of chromium), but further hot corrosion attack will substantially cease once the relatively high-chromium inner region of the overlay coating is encountered.

In view of the above, the present invention provides an overlay coating that is suitable for use as a bond coat or an environmental coating, and which can be applied as a single coating on all exposed surfaces of a component to provide a balance of oxidation and hot corrosion resistance.

Other objects and advantages of this invention will be better appreciated from the following detailed description.

DETAILED DESCRIPTION

Figure 1:
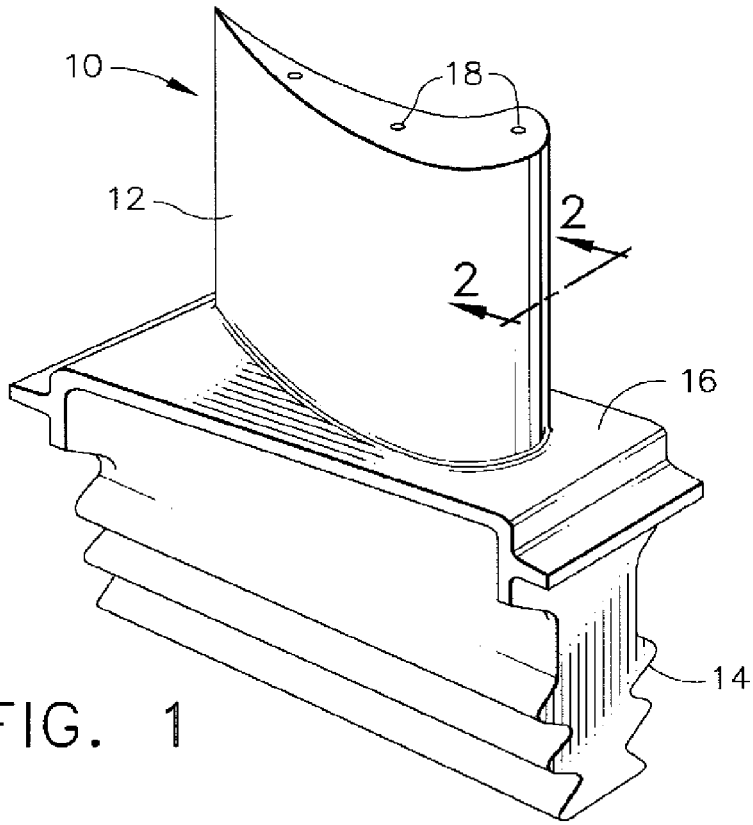
FIG. 1 is a perspective view of a high pressure turbine blade.

FIG. 1 depicts a high pressure turbine blade 10 that includes an airfoil 12 against which hot combustion gases are directed during operation of the gas turbine engine in which the blade 10 is installed. As such, the surface of the airfoil is subjected to severe attack by oxidation, hot corrosion, etc. The airfoil 12 is anchored to a turbine disk (not shown) with a dovetail 14 formed on a root section 16 of the blade 10. Cooling holes 18 are present in the airfoil 12 through which bleed air is forced to transfer heat from the blade 10. While the advantages of this invention will be described with reference to the high pressure turbine blade 10 shown in FIG. 1, the teachings of this invention are generally applicable to any component on which a coating system may be used to protect the component from its environment.

Figure 2:
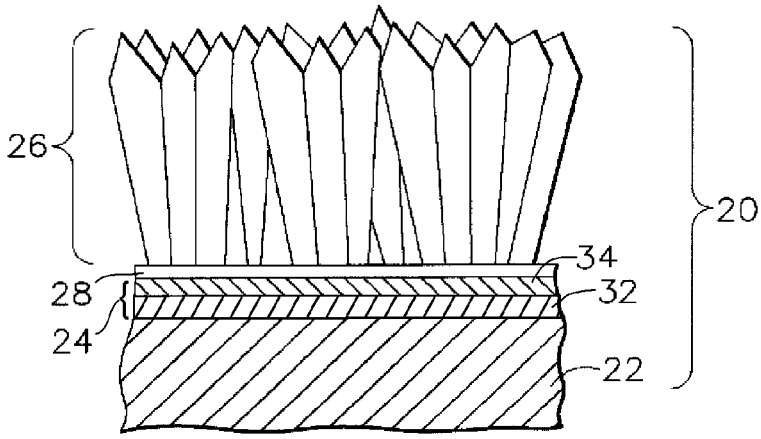
FIG. 2 is a cross-sectional view of the blade of FIG. 1 along line 2—2, and shows a thermal barrier coating system on the blade in accordance with an embodiment of this invention.

Represented in FIG. 2 is a TBC system 20 in accordance with an embodiment of the invention. As shown, the coating system 20 includes a ceramic layer 26 bonded to the blade substrate 22 with an overlay coating 24, which therefor serves as a bond coat to the ceramic layer 26. The substrate 22 (blade 10) is preferably a high-temperature material, such as an iron, nickel or cobalt-base superalloy. To attain the strain-tolerant columnar grain structure 30 represented in FIG. 2, the ceramic layer 26 is preferably deposited by physical vapor deposition (PVD), though other plasma spray deposition techniques could be used. A preferred material for the ceramic layer 26 is an yttria-stabilized zirconia (YSZ), with a suitable composition being about 3 to about 20 weight percent yttria, though other ceramic materials could be used, such as yttria, nonstabilized zirconia, or zirconia stabilized by ceria ($CeO_2$), scandia ($Sc_2O_3$) or other oxides. The ceramic layer 26 is deposited to a thickness that is sufficient to provide the required thermal protection for the underlying substrate 22 and blade 10, generally on the order of about 100 to about 300 micrometers. As with prior art TBC systems, the overlay coating 24 contains sufficient aluminum so that its surface oxidizes to form an adherent oxide layer (scale) 28 to which the ceramic layer 26 chemically bonds.

While shown in combination with the ceramic layer 26 to yield a TBC system 20, for applications in which a thermal barrier is not required the ceramic coating 26 can be omitted so that the overlay coating 24 serves as an environmental coating, with the oxide scale 28 acting as a protective barrier to oxidation. As such, the overlay coating 24 is suitable as a bond coat for the ceramic layer 24 as well as an environmental coating.

According to the invention, the overlay coating 24 is predominantly of the beta NiAl phase (beta-NiAl) with certain alloying additions. To attain the beta-NiAl intermetallic phase, the overlay coating 24 has an aluminum content of about 30 to 60 atomic percent. According to this invention, the overlay coating 24 also contains chromium, with the chromium content in the coating 24 being higher within an inner region 32 of the coating 24 and lower within an outer region 34 of the coating 24, the latter of which preferably defines the outer surface of the coating 24. According to a preferred aspect of the invention, the aluminum content also varies within the coating 24, with the aluminum content being higher in the outer region 34 than in the inner region 32. As such, the overlay coating 24 may be termed a dual alloy coating, with a relatively high-aluminum, low-chromium outer region 34 and a relatively low-aluminum, high-chromium inner layer 32. The inner and outer regions 32 and 34 may be formed as discrete layers, or be the result of a gradual change in the composition of the coating 24. For example, the chromium content of the overlay coating 24 can gradually increase from the coating surface toward the underlying substrate 22.

The intent of the dual alloy overlay coating 24 of this invention is to provide a single protective coating that can be deposited on a component (e.g., the blade 10) having surface regions that are particularly prone to oxidation as a result of being subjected to relatively high temperatures (e.g., above about 1100° C.), while other regions of its surface are more prone to hot corrosion as a result of being subjected to lower temperatures (e.g., below about 950° C.). By appropriately minimizing the chromium content of the outer region 34, such as levels of 5 weight percent or less, oxidation resistance is enhanced for those regions of the blade 10 that are prone to oxidation, particularly if the outer region 34 is enriched with aluminum. On the other hand, within those regions of the blade 10 prone to hot corrosion, hot corrosion may proceed through the outer region 34 as a result of its relatively lower chromium content but will then stop when the high-chromium inner region 32 of the coating 24 is encountered.

A suitable chromium content for the outer region 34 of the coating 24 is about 1 to 5 weight percent (about 0.8 to 3.9 atomic percent), preferably about 2 weight percent, while a chromium content of 5 to 20 weight percent (about 4 to 19 atomic percent), preferably about 10 weight percent, is desired for the inner region 32 of the coating 24. The compositions of the NiAl intermetallic within both the inner and outer regions 32 and 34 are preferably alloyed to contain a reactive element, with preferred compositions based on NiAlCrZr. A suitable composition for the inner region 32 is, by weight, about 20% to 30% aluminum, about 5% to 20% chromium, about 0.2 to 1.5% zirconium, and the balance nickel and incidental impurities. A suitable composition for the outer region 34 is, by weight, about 20% to 30% aluminum, about 1% to 5% chromium, about 0.2 to 1.5% zirconium, and the balance nickel and incidental impurities. In a preferred embodiment in which the outer region 34 has a higher aluminum than the inner region 32, it is foreseeable that the aluminum content of the inner region 32 could be less than 18 weight percent, in which case a suitable minimum aluminum content for the outer region 34 is at least 18 weight percent.

The NiAl overlay coating 24 is preferably deposited in a single coating cycle using a PVD process such as sputtering, ion plasma, cathodic arc, or melting and evaporation with an electron beam, laser or other higher energy source. It is foreseeable that other deposition techniques could be used, such as thermal spraying of powders including air plasma spraying (APS) and low pressure plasma spraying (LPPS) techniques. The inner region 32 is deposited using a coating source (e.g., ingot if deposited by a melting and evaporation technique; powder if deposited by a spraying technique) having a relatively higher chromium content than the coating source for the outer region 34. Precise control of when the inner region 32 ends and the outer region 34 begins is not believed to be necessary. To protect the underlying substrate 22 and provide an adequate supply of aluminum for formation of the protective oxide scale 28, a suitable thickness for each region 32 and 34 of the overlay coating 24 is about 25 micrometers for a total thickness of about 50 micrometers, though thicknesses of about 15 to about 100 micrometers are believed to be acceptable for each region. Preferably, deposition of the overlay coating 24 results in virtually no diffusion between the overlay coating 24 and substrate 22. During subsequent heat treatment to relieve residual stresses generated during the deposition process, a very thin diffusion zone, typically not more than about five micrometers, may develop. A suitable heat treatment is two to four hours at about 1800° F. to 2100° F. (about 980° C. to about 1150° C.) in a vacuum or an inert atmosphere such as argon.

While the invention has been described in terms of a preferred embodiment, it is apparent that modifications could be adopted by one skilled in the art. For example, based on investigations reported in U.S. Pat. No. 6,153,313, it is believed that the overlay coating of this invention could be modified to further contain one or more of hafnium, yttrium, titanium, tantalum and silicon, as well as possible additions of platinum, rhenium and/or ruthenium. Accordingly, the scope of the invention is to be limited only by the following claims.

What is claimed is:

1. A coating system on a substrate, the coating system comprising a beta-phase NiAl intermetallic overlay coating comprising inner and outer regions, the inner and outer regions being deposited from first and second coating sources, respectively, the first coating source having a higher chromium content than the second coating source so that the inner region contains more chromium than the outer region.

2. A coating system according to claim 1, wherein the inner region of the overlay coating contains, by weight, about 5% to about 20% chromium, and the outer region of the overlay coating contains, by weight, about 1% to about 5% chromium.

3. A coating system according to claim 1, wherein the overlay coating contains nickel, aluminum, chromium, and zirconium and optionally one or more of hafnium, yttrium, titanium, tantalum, silicon, platinum, rhenium and ruthenium.

4. A coating system according to claim 1, further comprising a limited diffusion zone between the substrate and the inner region of the overlay coating, the diffusion zone containing elements that have interdiffused from the substrate and the overlay coating.

5. A coating system according to claim 4, wherein the inner region of the overlay coating consists of, by weight, about 20% to about 30% aluminum, about 5% to about 20% chromium, about 0.2 to about 1.5% zirconium, the balance nickel and incidental impurities.

6. A coating system according to claim 4, wherein the outer region of the overlay coating consists of, by weight, about 20% to about 30% aluminum, about 1% to about 5% chromium, about 0.2 to about 1.5% zirconium, the balance nickel and incidental impurities.

7. A coating system according to claim 1, wherein the inner region of the overlay coating contains about 10 weight percent chromium.

8. A coating system according to claim 1, wherein the outer region of the overlay coating contains about 2 weight percent chromium.

9. A coating system according to claim 1, wherein the outer region of the overlay coating contains more aluminum than the inner region.

10. A coating system according to claim 1, wherein the inner and outer regions are discreet layers of the overlay coating.

11. A coating system according to claim 1, wherein the inner and outer regions are not discreet layers of the overlay coating.

12. A coating system according to claim 1, further comprising a thermal-insulating ceramic layer adhered to the overlay coating.

13. A coating system on a gas turbine engine component, the coating system comprising a beta-phase NiAl intermetallic overlay coating, the overlay coating comprising an inner region and an outer region that defines an outer surface of the overlay coating, the inner region consisting of, by weight, 20% to 30% aluminum, about 5% to about 20% chromium, about 0.2% to about 1.5% zirconium, the balance nickel and incidental impurities, the outer region consisting of, by weight, 20% to 30% aluminum, about 1% to about 5% chromium, about 0.2% to about 1.5% zirconium, the balance nickel and incidental impurities, the inner region containing more chromium than the outer region.

14. A coating system according to claim 13, wherein the inner region of the overlay coating contains about 10 weight percent chromium.

15. A coating system according to claim 13, wherein the outer region of the overlay coating contains about 2 weight percent chromium.

16. A coating system according to claim 13, wherein the outer region of the overlay coating contains more aluminum than the inner region.

17. A coating system according to claim 13, further comprising a limited diffusion zone between the substrate and the inner region of the overlay coating, the diffusion zone having a thickness of not more than about five micrometers and containing elements that have interdiffused from the substrate and the overlay coating.

18. A coating system according to claim 13, wherein the inner and outer regions are discreet layers of the overlay coating.

19. A coating system according to claim 13, wherein the inner and outer regions are not discreet layers of the overlay coating.

20. A coating system according to claim 13, further comprising a thermal-insulating ceramic layer adhered to the overlay coating.

* * * * *